United States Patent [19]

Wada et al.

[11] Patent Number: 4,482,839

[45] Date of Patent: Nov. 13, 1984

[54] THERMIONIC EMISSION CATHODE AND PREPARATION THEREOF

[75] Inventors: Tetsuya Wada; Masaji Ishii; Akira Miyai; Hirotoshi Hagiwara, all of Machida, Japan

[73] Assignee: Denki Kagaku Kogyo Kabushiki Kaisha, Tokyo, Japan

[21] Appl. No.: 341,078

[22] Filed: Jan. 20, 1982

[30] Foreign Application Priority Data

May 29, 1981 [JP] Japan ..... 82049

[51] Int. Cl.[3] ..... H01J 1/14; H01J 19/06; H01K 1/04

[52] U.S. Cl. ..... 313/346 R; 313/336; 445/51

[58] Field of Search ..... 313/238, 346, 350, 331, 313/336; 29/25.14, 25.15, 25.17; 156/380.2, DIG. 63, DIG. 78

[56] References Cited

U.S. PATENT DOCUMENTS

| | | | |
|---|---|---|---|
| 3,312,856 | 4/1967 | Lafferty et al. | 313/346 |
| 3,440,475 | 4/1969 | Schiller et al. | 313/337 |
| 3,823,337 | 5/1974 | Johannes et al. | 313/346 |
| 3,833,494 | 9/1974 | Johannes et al. | 204/181 |
| 4,055,780 | 10/1977 | Kawai et al. | 313/346 |
| 4,137,476 | 1/1979 | Ishii | 313/336 |
| 4,168,565 | 9/1979 | Ishii et al. | 29/25.14 |

*Primary Examiner*—William L. Sikes
*Assistant Examiner*—Robert E. Wise
*Attorney, Agent, or Firm*—Oblon, Fisher, Spivak, McClelland & Maier

[57] ABSTRACT

A thermionic emission cathode comprises a cathode tip made of an alkaline earth metal or rare earth metal hexaboride, a metallic support for supporting a base of said cathode tip and a reaction barrier layer comprising colloidal carbon and a reaction barrier material which bonds said cathode tip and said metallic support in one body.

7 Claims, 8 Drawing Figures

THERMIONIC EMISSION CATHODE AND PREPARATION THEREOF

BACKGROUND OF THE INVENTION

1. Field of the Invention

The present invention relates to a thermionic emission cathode. More particularly, it relates to a thermionic emission cathode bonding a cathode tip made of hexaboride having calcium hexaboride structure and a metallic support with a reaction barrier layer containing colloidal carbon and a preparation thereof.

2. Description of the Prior Art

An alkaline earth metal or rare earth metal hexaboride having calcium hexaboride cubic crystalline structure (hereinafter referring to as hexaboride) usually has excellent physical properties such as small power factor, high melting point, high strength at high temperature, high brightness and long life and accordingly it is useful as a thermionic emission cathode substance. When it is used for a thermionic emission cathode, a reaction of the hexaboride with a metal of the metallic support for supporting is quite severe at an electron emission temperature of about 1500 to 1600° C. In the use of the hexaboride for a thermionic emission cathode, it is necessary to form a reaction barrier layer to prevent the reaction. The reactivity of the hexaboride with carbon is relatively low at high temperature. Therefore, it has been proposed to hold the hexaboride tip by an anisotropic carbon. However, large electric power is required for heating the thermionic emission cathode in this manner. Moreover, it has been difficult to directly hold it on an electron gun of an instrument equipped with a conventional tungsten hair pin type cathode such as an electron microscope shown in FIG. 1. A large power capacity has been required.

It has been proposed to overcome these disadvantages of the conventional thermionic emission cathode in Japanese Unexamined Patent Publication No. 64268/1977 and No. 64269/1977 which propose cathodes placing a reaction barrier layer containing zirconium boride, titanium boride, niobium boride, hafnium boride, chromium boride, zirconium nitride, niobium nitride, vanadium nitride and hafnium nitride, between a hexaboride tip and a metallic support made of tantalum, molybdenum or tungsten. The cathode has the advantage for preventing the reaction of the hexaboride with the high melting point metal such as Ta, Mo and W, however, the bonding property of the reaction barrier layer made of zirconium boride, etc. and the hexaboride is inferior to disconnect the hexaboride cathode tip in the use for a long time.

SUMMARY OF THE INVENTION

It is an object of the present invention to provide a thermionic emission cathode holding a cathode tip on a metallic support without any disconnection.

The foregoing and other objects of the present invention have been attained by providing a thermionic emission cathode which comprises a cathode tip made of an alkaline earth metal or rare earth metal hexaboride, a metallic support for supporting a base of said cathode tip and a reaction barrier layer comprising colloidal carbon and a reaction barrier material which bonds said cathode tip and said metallic support in one body.

DETAILED DESCRIPTION OF THE PREFERRED EMBODIMENTS

Figure 1:
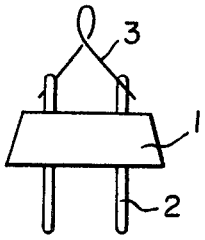
FIG. 1 is a schematic view of the conventional thermionic emission cathode.

In accordance with the present invention, the cathode tip and the metallic support having high melting point are bonded with a paste containing colloidal carbon and a reaction barrier material in sintering in an inert atmosphere to form a bonding layer having high bonding strength on the boundary of the reaction barrier layer. The bonding layer does not cause any damage to the cathode tip and imparts effect for preventing an oxidation.

The bonding and reaction barrier layer is quite effective for preventing an oxidation of the cathode tip and preventing a reaction with the metallic support. Therefore, it is possible to prevent the disconnection of the cathode tip caused by consumption. The cathode can be used instead of the conventional tungsten cathode and can impart excellent electron beam characteristics of the hexaboride cathode tip. The colloidal carbon has good dispersibility for the powdery reaction barrier material and the paste of the mixture of the colloidal carbon and the reaction barrier material has good coating processability and good adhesiveness before sintering at high temperature. Further, the colloidal carbon can readily be sintered, and when heated under the condition that slight pressure is given to the cathode tip and the metallic support, it provide a sufficient bonding strength.

The hexaborides used in the present invention can be alkaline earth metal or rare earth metal hexaborides having calcium hexaboride type cubic crystalline structure and include $LaB_6$, $CaB_6$, $EuB_6$, $BaB_6$ and $SmB_6$.

When the hexaboride is used for the thermionic emission cathode, a polycrystalline crystal or a single crystal is prepared and a rod is cut out to obtain a tip having a size of about 0.5 mm×0.5 mm×1.2 mm and the top is processed in a sharp form by an elctrolytic polishing or a mechanical polishing.

The metallic support used in the present invention is made of a metal having a high melting point such as Ta, Mo and W, and it has a function to mechanically support the cathode tip so as to reinforce the bonding strength of the bonding agent comprising the colloidal carbon and the reaction barrier material.

The colloidal carbon is fine powder having a particle diameter ranging from 0.01 to 500μ and can be a commercially available product.

The reaction barrier material used in the present invention has high melting point and forms a dense bonding layer by reacting with a part of the hexaboride and a part of the metallic support in the heating of the mixture of the reaction barrier material and the colloidal carbon in an inert atmosphere. The bonding layer is quite dense so as to prevent further reaction with the hexaboride and the metallic support and firmly bonded to the hexaboride and the metallic support.

The reaction barrier material having such properties can be metals having high melting point such as Ti, Zr, Ta, Nb, Hf, V, Re and rare earth metals, boron carbide and borides, carbides, silicides and nitrides of the aforementioned metal such as zirconium boride, titanium boride, niobium boride, hafnium boride, chromium boride, zirconium nitride, niobium nitride, vanadium nitride, hafnium nitride and tantalum carbide.

A ratio of the colloidal carbon to the reaction barrier material as solid is in a range of 200 to 10 part by volume preferably more than 20 part by volume per 100 part by volume. When the content of the colloidal carbon is too much, the bonding strength is inferior and the consumption caused by oxidation is much and the disconnection of the cathode is caused even though the tip edge is still useful. When the content of the colloidal carbon is too small, the adhesiveness and the processability before forming the bonding layer are inferior. The particle size of the reaction barrier material is preferably fine so as to be easily blended and to form a uniform paste. In view of the processing, the particle diameter is preferably 100μ or less especially 20μ or less.

The paste used for the preparation of the bonding layer is prepared by thoroughly mixing the colloidal carbon and the reaction barrier material, if necessary with water or the other solvent.

In the assembling of the thermionic emission cathode, a tungsten wire is used as the metallic support and the base of the cathode tip is adhered to the tungsten wire with the paste. It is also possible to adhere the base of the cathode tip in a metallic support cup such as a tantalum cup with the paste and to weld a tungsten wire by a spot welding. The assembly is sintered in one body in an inert atmosphere.

The sintering temperature is not critical and is usually in a range of 1500 to 1700° C. When a sintering time is short, the sintering temperature can be 2000° C. or higher.

The resulting bonding layer has high bonding strength. Thus, the reaction barrier layer having further high bonding strength can be formed by hot pressing under a pressure of about 1 to 100 g/cm$^2$ in an inert atmosphere. Since the pressure is low, the cathode tip is unlikely to be broken. Thus, the disconnection of the cathode tip is prevented.

The present invention will be further illustrated by examples and references referring to the drawings which are provided for purposes of illustration only and are not intended to be limiting the invention.

FIG. 1 is a schematic view of the conventional tungsten hair pin thermionic emission cathode wherein the reference numeral (1) designates a base of the thermionic emission cathode for fixing two lead wires (2) and both ends of a tungsten wire (3) as the hair pin type thermionic emission cathode were respectively connected to the ends of the lead wire (2).

Figure 2:
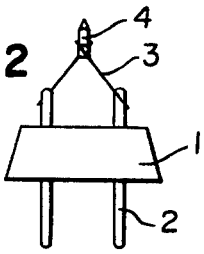
FIG. 2 is a schematic view of the thermionic emission cathode of the present invention.

FIG. 2 shows the thermionic emission cathode of the present invention wherein a hexaboride cathode tip (4) was held at the center of the tungsten wire (3). Thus, the brightness was remarkably improved and the life was remarkably prolonged.

Figure 3:
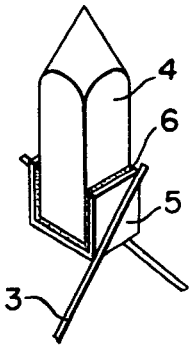
FIGS. 3, 5 and 8 are respectively enlarged schematic views of the hexaboride cathode tip.

FIG. 3 is an enlarged schematic view of the hexaboride cathode tip wherein the reference numeral (5) designates a tantalum cup for holding the cathode tip (4) made of polycrystalline lanthanum hexaboride. The tantalum plate having a thickness o 0.1 mm was bent in a form having ⊐-shape sectional view as the metallic support. The reference numeral (6) designate a paste for bonding the cathode tip (4) and the tantalum cup (5). Colloidal carbon (Hitasol) and titanium powder were blended at a ratio of 1:5 by volume and the paste was prepared by kneading the mixture with water and was coated between the cathode tip (4) and the tantalum cup (5). This coated paste was converted into a bonding layer by sintering. The coated paste was dried and the ends of the tungsten wires (3) held on the base of the thermionic emission cathode (1) were respectively welded on both surfaces of the tantalum cup (5) by a spot welding.

The resulting lanthanum hexaboride cathode was heated by an electric heating in a vacuum of the order of $10^{-7}$ Torr (1600° C. of the temperature at the top of the $LaB_6$ tip) for about 15 minutes whereby the paste (6) was converted into the reaction barrier layer to maintain excellent mechanical and thermal connection between the cathode tip (4) and the tantalum cup (5). The electric power for heating the top of the tip at 1600° C. can be less depending upon decrease of sizes of the tip and the tantalum cup. When the size of the cathode tip (4) is too small, the life of the cathode is short because of the evaporated consumption of the cathode tip (4). Therefore, the sizes are decided in view of a desired life and an electric power source capacity for heating the electron gun. In the example, a tip having a size of 0.4 mm×0.5 mm×1.2 mm and a tantalum plate having a width of 0.5 mm and a length of 0.7 mm were used and the cathode was heated at 1600° C. by the electric power of 5.2 Watt. The brightness of the cathode was about 5 times by that of the conventional tungsten hair pin type cathode in $10^5$A/cm$^2$. str. as those of the other thermionic emission cathodes made of polycrystalline lanthanum hexaboride.

The bonding of the cathode tip (4) and the tantalum cup (5) was quite firm and was durable in a repeat switching test. The appearance of the reaction barrier layer was not changed after the use for 500 hours. The top of the cathode was embedded in a resin after the use for 5000 hours and the reaction of the tip, the reaction barrier layer and the tantalum plate (3) was observed by the conventional method.

As a result, the formation of titanium boride, carbide or carbide-boride was observed between the tip and the reaction barrier layer to form the bonding layer. On the other hand, a bonding layer having metallic luster was observed between the reaction barrier layer and the tantalum plate. According to X-ray analysis, it is found that carbon is diffused into tantalum to form the carbide.

Figure 4:
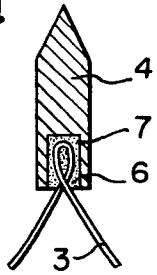
FIG. 4 is an enlarged sectional view of the hexaboride cathode tip.

FIG. 4 is an enlarged sectional view of a part of the other example of the hexaboride cathode tip. In the embodiment, a connectionhole (7) having a diameter of 0.2 mm and a depth of about 1 mm was formed by a ultrasonic processing machine, on a bottom of the hexaboride cathode tip (4) having a size of 0.75 mm×0.75 mm×1.5 mm. A paste (6) prepared by kneading colloidal carbon and zirconium boride powder at a ratio of 2:1 by weight with water was coated on a bent part of tungsten wire (3) having a diameter of 0.1 mm as a metallic support. The end of the tungsten wire was inserted into the connectionhole (7) and the paste was coated to fill the space since if the space is remained, the heat transfer from the tungsten wire is less to require much electric power for heating.

After drying the paste, the cathode was heated by an electric heating in vacuum of an order of $10^{-7}$ Torr. An electric power of 5.5 Watt is required to heat it at 1600° C. When it was heated for 370 hours, the tungsten wire become thin to be cut and the test was stopped.

Figure 5:
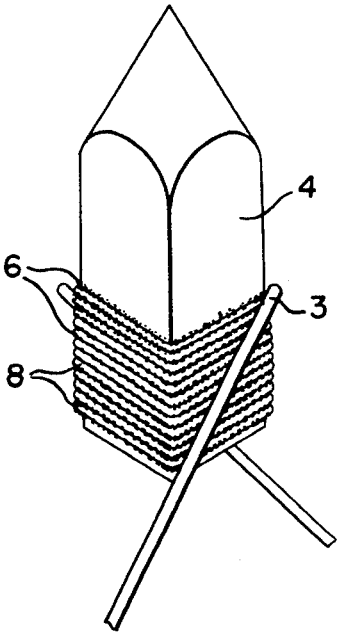
Figure 6:
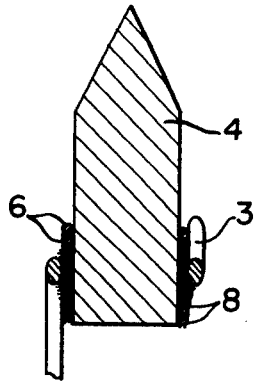
FIG. 6 is an enlarged vertical sectional view of the cathode tip shown in FIG. 5.

FIG. 5 is an enlarged schematic view of the top of the other example of the hexaboride cathode tip and FIG. 6 is a vertical sectional view of the top.

In the example, a tantalum wire (8) having a diameter of 0.1 mm was wound as a metallic support on the base of the lanthanum hexaboride cathode tip (4) having a size of 0.4 mm×0.4 mm×1.5 mm at the part for about ⅓. A tungsten wire (3) held on the base of the cathode was welded on the outer surface of the tantalum wire (8) by a spot welding. A paste (6) prepared by kneading colloidal carbon and tantalum carbide powder at a ratio of 1:1 with water was coated on the welded part. It is possible to coat the paste (6) on the base of the cathode tip (4) and then, to wind the tantalum wire (8) and to dry the paste and to spot-weld the tungsten wire (3). The paste (6) is heated in an inert atmosphere to form a bonding layer having high bonding strength between the cathode tip (4) and the tantalum wire.

In this example, the results of the heating test was similar to those of the example shown in FIG. 3.

Figure 7:
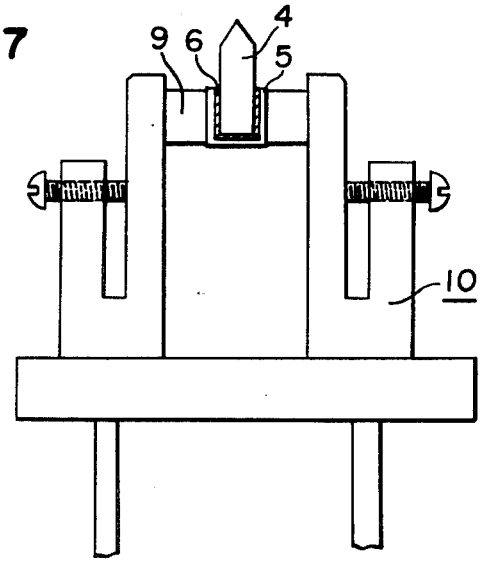
FIG. 7 is a sectional view of a holder for heat-press.
Figure 8:
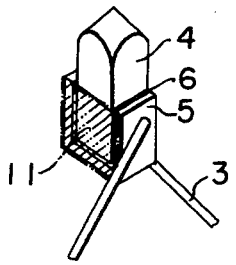

FIGS. 7 and 8 show the other example for completely preventing disconnection of a cathode tip caused by an oxidizing consumption. A cathode tip of a single crystal lanthanum hexaboride (4) had a size of 0.4 mm×0.5 mm×1.2 mm and a polished top having a conical vertical angle of 90 degree and a curvature of 10 μmR. A tantalum cup (5) was prepared by bending a tantalum plate having a thickness of 0.1 mm in a form of ⊐-shape sectional view. A paste (6) prepared by kneading colloidal carbon ad titanium powder at 5:1 by volume with water was coated on the base of the cathode tip (4) and the coated base was inserted into the tantalum cup (5). This was held by a heater block (9) made of thermally decomposed graphite with a holder (10) shown in FIG. 7 and it was heat-pressed by an electric heating in vacuum of an order of $10^{-7}$ Torr. under a pressure o 5 g/cm$^2$ at 1900° C. of the temperature of the tip for 3 minutes. The temperature of the tip can be in a range of 1700 to 2100° C. Since the heating time was short, no adverse effect to the $LaB_6$ cathode tip was found even though the temperature was high.

The heater block (9) can be made of anisotropic carbon or glassy carbon as well as the thermally decomposed graphite. In the hot press treatment, a reaction barrier layer having dense bonding layers were formed between the cathode tip (4) and the tantalum cup (5). Tungsten wires (3) were welded on both edges of the tantalum cup (5) by a spot weld. A second paste (11) containing colloidal carbon and $B_4C$ at a ratio of 1:2 by volume was coated on both sides which were not covered with the tantalum plate and the cathode tip was heated by an electric heating in vacuum of $10^{-7}$ Torr. at 1600° C. of the temperature of the tip.

In accordance with this example, the base of the cathode tip (4) is surrounded by the first and second reaction barrier layers whereby the effect for preventing the oxidation is further increased. The cathode cup and the metallic tip are firmly bonded by the heat-press treatment. The thermionic emission cathode which can be heated in constant at 1600° C. by an electric power of 5–6 Watt can be obtained.

In accordance with the present invention, it is possible to provide a thermionic emission cathode which can be easily replaced to the conventional tungsten hair pin type cathode, without any reduction of excellent thermionic emission characteristics of the hexaboride, for example, a thermionic emission cathode which imparts a brightness of 7 times by that of the tungsten cathode by an electric power of 5–6 Watt and has a life of 200–500 hours which is 4–10 times by that of the tungsten cathode.

We claim:

1. A thermionic emission cathode which comprises a cathode tip made of an alkaline earth metal or rare earth metal hexaboride, a metallic support for the cathode tip to mechanically hold the base portion of said cathode tip and a bonding layer comprising colloidal carbon and a reaction barrier material which bonds said cathode tip and said metallic support in one body.

2. The thermionic emission cathode according to claim 1 wherein the metallic support is fabricated in a ⊐-shape and the base portion of the cathode tip is inserted therein.

3. The thermionic emission cathode according to claim 1 wherein the metallic support is fabricated in a form of ⊐-shape, the base portion of the cathode tip is inserted therein, and an anti-oxidizing layer is formed by coating a paste containing colloidal carbon and $B_4C$ on both sides of the base portion of the cathode tip which are not in contact with the metallic support and heating it in vacuum.

4. The thermionic emission cathode according to claim 1 wherein a hole is made on the base portion of the cathode tip and the metallic support is inserted therein.

5. The thermionic emission cathode according to claim 1 wherein the metallic support is formed by winding wires of a high melting point metal on the base portion of the cathode tip.

6. A process for producing a thermionic emission cathode which comprises bonding a base of a cathode tip made of an alkaline earth metal or rare earth metal hexaboride on a metallic support with a paste comprising a reaction barrier material and colloidal carbon; and sintering it in an inert atmosphere.

7. A process for producing a thermionic emission cathode which comprises bonding a base of a cathode tip made of an alkaline earth metal or rare earth metal hexaboride on a metallic support with a paste comprising a reaction barrier material and colloidal carbon; and hot pressing it in an inert atmosphere.

* * * * *